US007418905B2

(12) United States Patent
Bootes et al.

(10) Patent No.: US 7,418,905 B2
(45) Date of Patent: Sep. 2, 2008

(54) MULTI-MISSION PAYLOAD SYSTEM

(75) Inventors: Thomas H. Bootes, Tucson, AZ (US); Jesse T. Waddell, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 451 days.

(21) Appl. No.: 10/741,955

(22) Filed: Dec. 19, 2003

(65) Prior Publication Data

US 2005/0223930 A1 Oct. 13, 2005

(51) Int. Cl.
*F42B 12/16* (2006.01)

(52) U.S. Cl. ..... 102/476; 102/489; 102/493

(58) Field of Classification Search ..... 102/473, 102/476, 489, 493, 374, 379, 475; 89/1.14, 89/1.4; 244/3.16

See application file for complete search history.

(56) References Cited

U.S. PATENT DOCUMENTS

| | | | | | |
|---|---|---|---|---|---|
| 2,690,314 | A * | 9/1954 | Porter et al. | ..... | 244/3.21 |
| 2,804,823 | A * | 9/1957 | Jablansky | ..... | 102/377 |
| 3,496,867 | A * | 2/1970 | MacDonald | ..... | 102/363 |
| 3,601,055 | A * | 8/1971 | Crockett | ..... | 102/377 |
| 3,906,860 | A * | 9/1975 | Johns | ..... | 102/476 |
| 4,132,170 | A | 1/1979 | Hardy et al. | | |
| 4,598,884 | A * | 7/1986 | Speer | ..... | 244/3.16 |
| 5,092,246 | A | 3/1992 | Huerta et al. | | |
| 5,291,830 | A * | 3/1994 | Zwan | ..... | 102/293 |
| 5,313,890 | A * | 5/1994 | Cuadros | ..... | 102/496 |
| 5,363,766 | A * | 11/1994 | Brandon et al. | ..... | 102/374 |
| 5,698,814 | A | 12/1997 | Parsons et al. | | |
| 5,780,766 | A | 7/1998 | Schroppel | | |
| 5,939,662 | A * | 8/1999 | Bootes et al. | ..... | 102/473 |
| 6,226,979 | B1 * | 5/2001 | Pate et al. | ..... | 60/253 |
| 2003/0127012 | A1 * | 7/2003 | Sharplin | ..... | 102/482 |

FOREIGN PATENT DOCUMENTS

| | | |
|---|---|---|
| DE | 199 17 144 | 4/1999 |
| FR | 2 603 375 | 8/1986 |

* cited by examiner

*Primary Examiner*—T. Nguyen
(74) *Attorney, Agent, or Firm*—Renner, Otto, Boisselle & Sklar, LLP

(57) ABSTRACT

A missile, such as a cruise missile, has a nose payload portion having a frangible nose cover and a relatively hard target penetration nose cone. The nose cone may have a liquid fuel tank within, and a chemical energy explosive charge, such as a shaped charge, aft of the liquid fuel tank. The target penetration nose cone enables perforation of certain types of targets prior to detonation of the chemical energy explosive and the liquid fuel. The frangible nose cover is configured to be easily perforated or otherwise removed by the explosive force of the chemical energy explosive charge when the missile system is utilized for the attack of hard targets. The nose payload portion may have a fragmentation case, with one or more features designed to enhance fragmentation during detonation of the explosive and/or the liquid fuel.

21 Claims, 8 Drawing Sheets

MULTI-MISSION PAYLOAD SYSTEM

BACKGROUND OF THE INVENTION

The invention relates to the general field of missiles, and in particular to long-range missiles such as cruise missiles.

Cruise missiles, such as the TOMAHAWK cruise missile manufactured by Raytheon Company, have long been in use for attacking targets from a long range. The increased employment of cruise missiles has resulted in their being used to attack a wider variety of targets. This has resulted in the production of different types of missiles and/or missile payloads, configured to attack different types of targets. This has been done since different targets require different payloads and methods of attack, for example, to achieve hard deeply buried target penetration or destruction of soft above ground targets. The different types of missiles and/or payloads required to defeat the wide variety of targets increases the need for obtaining and keeping in inventory a large number of missiles and/or payloads.

From the foregoing, it will be appreciated that multi-mission payload improvements with regard to such missiles and/or payloads would be desirable. This would result in enhanced missile lethality, greater mission flexibility and reduced inventory of specialized missiles and/or payloads.

SUMMARY OF THE INVENTION

According to an aspect of the invention, a missile has a target penetration nose cone for penetrating certain targets prior to detonation of an explosive charge.

According to another aspect of the invention, a missile nose cone includes a nose cone fuel tank.

According to yet another aspect of the invention, a missile nose cone includes a frangible nose cone cover.

According to a further aspect of the invention, a missile nose cone includes a fragmentation case.

According to a still further aspect of the invention, a fragmentation case for a missile or other munition includes a high strength adhesive layer in which are embedded a multiplicity of fragments.

According to another aspect of the invention, a missile nose payload portion includes a casing that includes a target penetration nose cone; and an explosive charge within the casing.

According to yet another aspect of the invention, a method of attacking a structural target with a missile, includes: perforating external structures of the target with a target penetration nose cone of a nose payload portion of the missile; and detonating an explosive charge of the nose payload portion within an inside target space of the target.

According to still another aspect of the invention, a missile nose payload portion includes: a casing; an explosive charge within the casing; and a nose fuel tank within the casing, forward of the explosive charge.

According to a further aspect of the invention, a munition fragmentation case includes a recessed area in the case filled with a high strength adhesive material embedded with a multiplicity of fragments.

According to a still further aspect of the invention, a method of making a munition fragmentation case, includes: adhering a multiplicity of fragments to a fragmentation wrap; embedding the fragments in a high strength adhesive that is in a recess in the missile nose payload case by placing the fragmentation wrap in contact with the high strength adhesive; curing the high strength adhesive; and removing the fragmentation wrap from contact with the high strength adhesive, wherein the removing leaves the fragments embedded in the high strength adhesive attached to the missile nose payload case.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which may not necessarily be to scale.

DETAILED DESCRIPTION

A missile, such as a cruise missile, has a nose payload portion having a frangible nose cover and a relatively hard nose cone for penetrating target structures. The nose cone may have a liquid fuel tank within, and a chemical energy explosive charge, such as a shaped charge, aft of the liquid fuel tank. The target penetration nose cone enables penetration of certain types of target structures prior to detonation of the chemical energy explosive and the liquid fuel. The frangible nose cover is designed to easily perforate during detonation of the explosive charge when the missile is used for penetration attack of very hard targets. The explosive charge used for penetration attack of very hard targets consists of a specialized warhead that generates a high velocity shaped charge jet when detonated with proper standoff distance from the target. Penetration performance of this high velocity jet requires minimal interference/attenuation from the missile nose cone structure directly in front of the warhead during the highly sensitive phase of early jet formation. Consequently, this critical requirement dictates the use of a low density frangible nose cover when the missile is used to attack very hard targets. The nose payload portion may have a fragmentation case, with one or more features designed to enhance fragmentation during detonation of the explosive and/or the liquid fuel. The fuel in the nose portion liquid fuel tank may be used to increase missile range, increase loiter time of the missile, and/or to enhance the explosive effect of the missile. An energetic additive, such as a thermobaric or pyrophoric material may be added to the liquid fuel prior to or during detonation of the nose portion, to increase the explosive power of the detonation.

Figure 1:
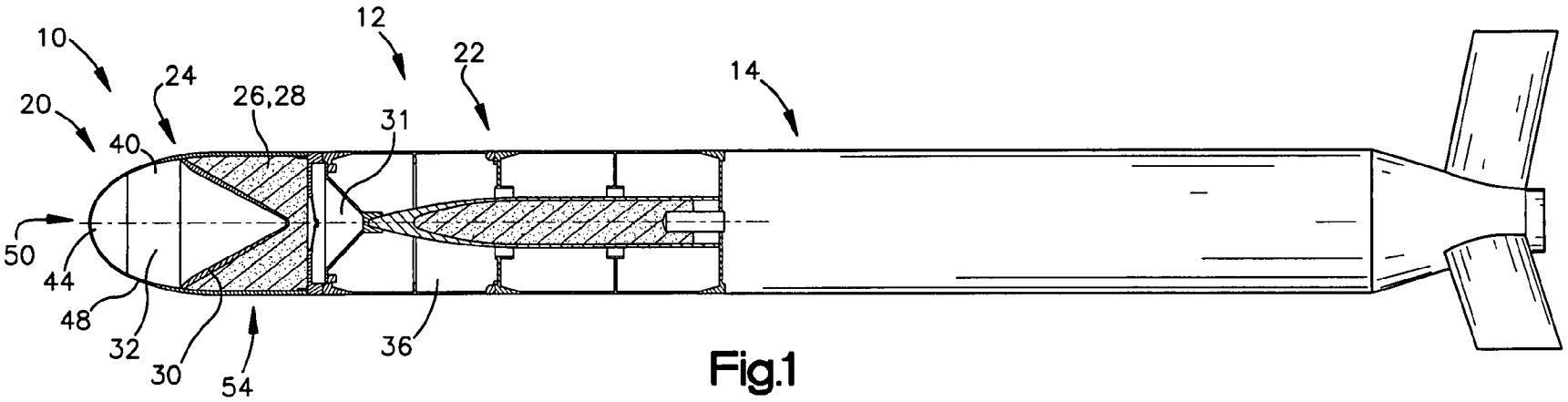
FIG. 1 is side view of a missile having a payload portion in accordance with the present invention.

Referring initially to FIG. 1, a missile 10, such as a surface-to-surface or air-to-surface cruise missile, includes a forward payload section 12 and an aft section 14. The missile 10, for example, may be a cruise missile such as a TOMAHAWK cruise missile. The aft section 14 contains components that are conventional for a missile such as a cruise missile. The aft section 14 thus may contain such common components as jet engines or rocket motors, guidance and communications equipment, and/or aerodynamic stabilization or control surfaces, such as fins or canards. These components, being conventional and well known in the art, are not discussed further herein.

The forward payload section 12 includes a nose payload portion 20, as well as a middle payload portion 22 that is between the nose payload portion 20 and the aft section 14. The nose payload portion 20 and the middle payload portion 22 contain payload items such as munitions to be delivered by the missile 10, and fuel. The nose payload portion 20 and the middle payload portion 22 may be modular, as is discussed further below.

Figure 2:
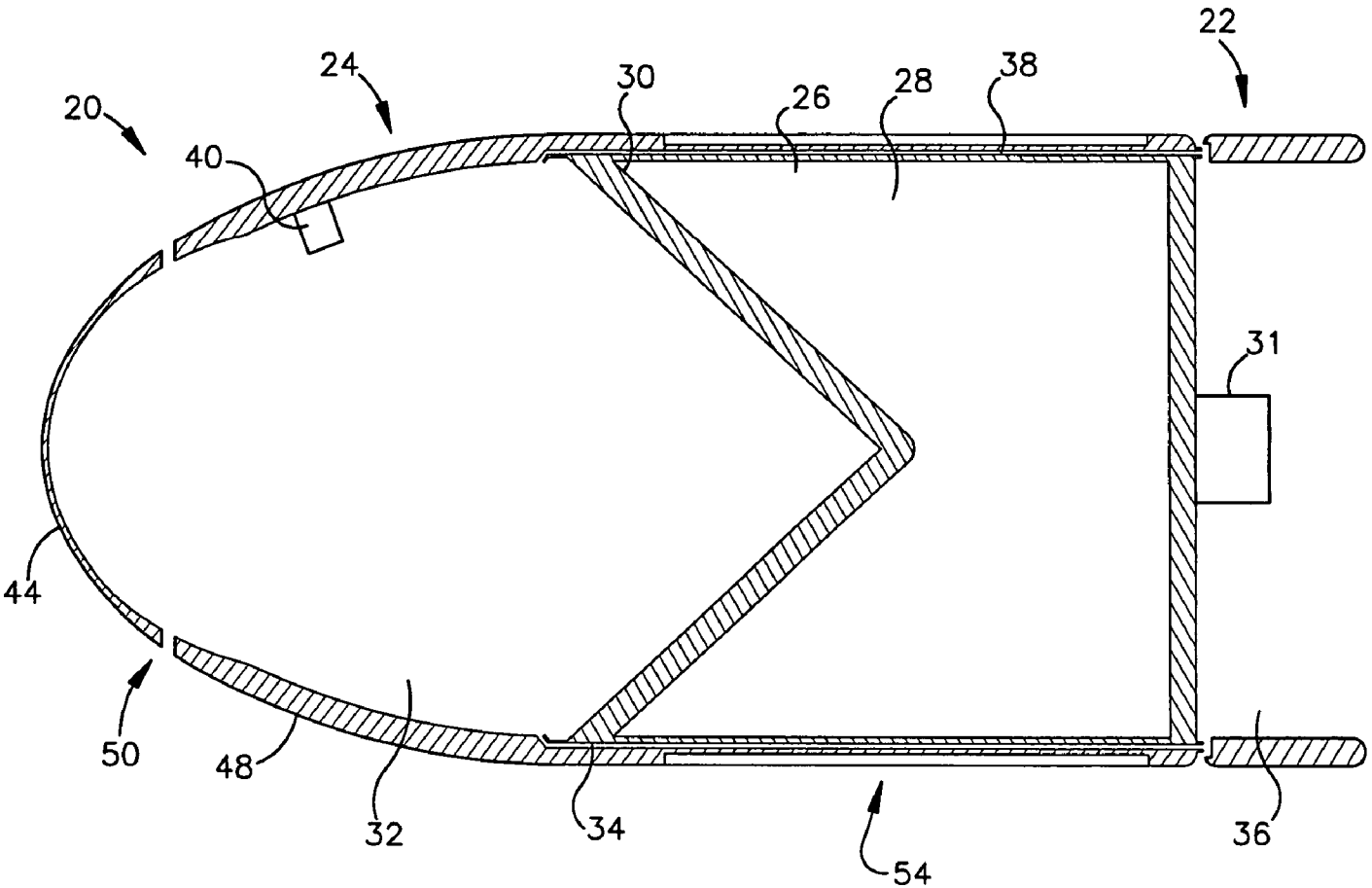
FIG. 2 is a side cross-sectional view of a nose payload portion of the missile of FIG. 1.

With reference now in addition to FIG. 2, details of the nose payload portion 20 are discussed. The nose payload portion 20 has a casing 24 that encloses a chemical energy explosive charge 26. An example of the explosive charge 26 is the shaped charge 28 shown in FIG. 2. The shaped charge 28 may be configured to send explosive force in a desired direction, such as toward the direction of the front of the missile 10. As an alternative to the shaped charge 28, the chemical energy explosive charge 26 may be another suitable type of explosive charge, such as a platter charge, an explosively formed penetrator, a flyer plate, or another explosive device or explosive filling.

The shaped charge 28 has a liner 30 on a forward part thereof. The liner 30 may be a suitable layer of aluminum. Alternatively, the liner 30 may be another suitable material, such as copper or tantalum.

The detonation of the chemical energy explosive charge 26 may be controlled by a fuze 31. The fuze 31 may be any of a variety of suitable fuzes. The fuze 31 may be preset, that is it may be configured before launch of the missile 10 to detonate at a predetermined altitude, or at a predetermined point within a sequence of events during flight of the missile 10 into a target. Alternatively, the fuze 31 may be re-configurable during flight, for example by use of suitable communication signals such as suitable radio waves. Communication may be done, for example, via aircraft or satellite systems. As a further alternative, the fuze 31 may include components for controlling detonation based on forces received by the missile 10 during target impact. For example, the fuze 31 may include an accelerometer, with forces detected by the accelerometer determining to some extent when the detonation of the chemical energy explosive charge 26 occurs.

A nose fuel tank 32 is located forward of the explosive charge 26. The nose fuel tank 32 may be initially filled with a suitable liquid fuel, for example jet fuel JP-10, that may be suitable for powering the jet engine in the aft missile section 14. The fuel in the nose fuel tank 32 may be used for increasing the flying or loiter time of the missile 10, and/or for increasing the explosive power of the missile 10. The fuel in the nose fuel tank 32 may also be used to increase the survivability of the chemical energy explosive charge 26 during nose cone penetration of targets. Fuel in the nose fuel tank will slow down, dampen and minimize the potential damage caused by the localized breakup of the target into fragments during the missile penetration event. The nose payload portion 20 includes a fuel transfer line 34 for transferring fuel from the nose fuel tank 32 to a mid-body fuel tank 36 aft of the nose payload portion 20, such as in the middle payload portion 22. An air pressure line 38 may be used to introduce air into the nose fuel tank 32 to compensate for the volume removed by transferring fuel from the nose fuel tank 32 to the mid-body fuel tank 36 via the fuel transfer line 34.

It will be appreciated that the fuel or fuel and air mixture in the nose fuel tank 32 may act as a separate fuel-air explosive, thereby increasing the explosive power of the chemical energy explosive charge 26. Explosion of the chemical energy charge 26 may cause fuel within the nose fuel tank 32 to disperse and aerosolize. It will also be appreciated that the fuel or fuel and air mixture in the mid-body fuel tank 36 may also act as a separate fuel-air explosive, thereby increasing the explosive power of the chemical energy explosive charge 26.

The nose payload portion 20 may include a fuel additive mechanism 40, such as a pressure bottle, a structural component, a coating or a liner for introducing an additive into the fuel of the nose fuel tank 32 slightly before or during detonation of the chemical energy explosive charge 26 and the fuel in the nose fuel tank 32. The additive may be a suitable thermobaric or pyrophoric material. Suitable materials include pyrophoric metal or metal powders, such as magnesium, aluminum, zirconium, or phosphorous. The fuel additives increase the explosive power of the liquid fuel in the nose fuel tank 32. It will be appreciated that the additive mechanism 40 may be in any of a variety of suitable places within the nose payload portion 20. Alternatively, the fuel additive may be on the surface of and/or dispersed within one or more of the components of the nose payload portion 20. For example, the fuel additive may be a coating on the liner 30 or on portions of the walls of the nose payload portion 20. As a further alternative, the fuel additive may be located in the middle payload portion 22.

The fuel additive may increase the explosive power of the fuel. However, introducing the fuel additive may interfere with the usefulness of the fuel for an engine, such as a jet engine, of the missile 10. Therefore, the fuel additive may be introduced into the nose fuel tank 32 just before detonation. Alternatively, the fuel additive may be located such that it is introduced to the fuel by the detonation and explosion process itself.

The nose payload portion 20 includes, as parts of the casing 24, a frangible nose cover 44 and a target penetration nose cone 48. The nose cover 44 is configured to be easily perforated or otherwise removed by the explosive force of the chemical energy explosive charge 26 when the missile system is utilized for hard target attack. The easily perforated frangible nose cover 44 ensures minimal degradation of a high speed shaped charge jet, that may be associated with the chemical energy explosive charge 26, during hard target penetration. The frangible nose cover 44 may include any of a variety of suitable materials, such as steel, titanium, aluminum, or composite materials. In a specific embodiment, the frangible nose cover 44 may be made of a low-to-moderate strength material such as aluminum or a composite and may have a thickness less than about 6.4 mm (0.25 inches). The frangible nose cover 44 may have a diameter less than about 75% of the diameter of the missile 10. More particularly, the frangible nose cover 44 may have a diameter less than about 75% of the largest diameter of the nose payload portion 20.

The target penetration nose cone 48 is coupled to the frangible nose cover 44. The target penetration nose cone 48 is configured to allow penetration of certain "soft" targets, such as targets having relatively thin layers of concrete or steel, or being made out of wood and/or composite materials. As described in greater detail below, use of the target penetration nose cone 48 allows parts of the nose payload portion 20, and/or other parts of the missile 10, to penetrate into a target, prior to detonation of the chemical energy explosive charge 26. Thus, the explosive power of the chemical energy charge 26 and any fuel-air mixture produced by the fuel and air in the nose fuel tank 32 may be delivered or emplaced within a structure, rather than being used to breach walls of the structure.

The target penetration nose cone 48 may be configured to perforate a given target of varying thicknesses composed of varying materials in different layers. Target thicknesses may vary from a few centimeters to over one meter. Concrete targets may have hardness values of up to 7000 psi. For example, the target penetration nose cone 48 may be configured to penetrate 10 cm (4 inch) thick to 15 cm (6 inch) thick or 30 cm (12 inch) thick 5000 psi concrete. The foregoing figures merely give example values of the penetrating-power of the target penetration nose cone 48. It will be appreciated that the target penetration nose cone 48 may have a greater or a lesser penetrating power. Moreover, it will be appreciated that the penetrating power of the target penetration nose cone 48 also depends upon such other factors as the speed of impact and the angle between the nose cone 48 and the impacted surface.

Figure 3:
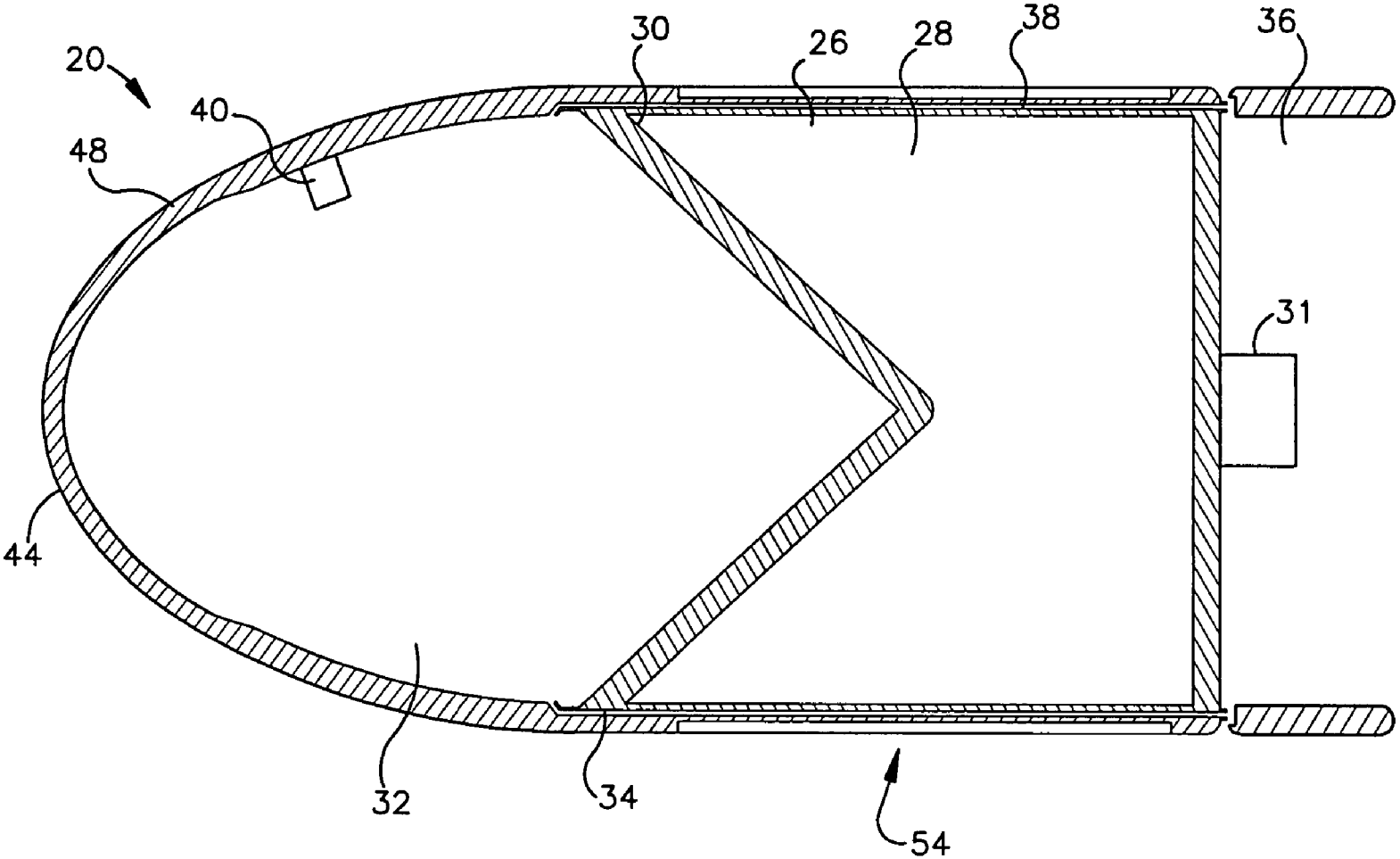
FIG. 3 is side sectional view of an alternate embodiment nose payload portion in accordance with the present invention.

The target penetration nose cone 48 may have a thickness of greater than 6.4 mm (0.25 inches) of high-strength material such as steel, titanium, carbon fiber composite or a combination of carbon fiber and titanium composite. The target penetration nose cone 48 may have a strength much greater than that of the frangible nose cover 44. The target penetration nose cone 48 may have a cutout 50 for receiving and mating with the frangible nose cover 44. The cutout 50 may have a diameter less than 75% of the overall diameter of the missile 10 and/or the nose payload portion 20. Alternatively, as illustrated in FIG. 3, the target penetration nose cone 48 may extend over the entire front surface of the nose payload portion 20. That is, the frangible nose cover 44 may be dispensed with entirely, and replaced by further extending the target penetration nose cone 48.

The diameter of the target penetrating nose cone 48 may be greater than about 13 cm (5 inches), although it will be appreciated that a variety of other diameters may be employed. The geometry of the outer surface of the nose payload portion 20, and in particular of the target penetration nose cone 48, may vary depending upon such factors as aerodynamic requirements of the missile 10 or components thereof, target penetration axial/lateral loads, and internal nose cone chemical energy explosive charge constraints. The overall shape of the nose payload portion 20 may be any of a variety of suitable shapes such as ogives, offset ogives, suitable elliptical shapes, or chines.

The presence of fuel in the nose fuel tank 32 may increase survivability of the nose structure, and in particular, the target penetration nose cone 48, during penetration. The presence of fuel in the nose fuel tank 32 may distribute mechanical loads generated during penetration, so as to increase structural survivability of the nose cone 48.

The nose payload portion 20 may include a fragmentation case 54 for providing enhanced fragmentation effects as a result of the detonation of the chemical energy explosive charge 26 and/or the air-fuel mixture including fuel from the nose fuel tank 32. Various embodiments of the fragmentation case 54 are illustrated in FIGS. 4-6.

Figure 4:
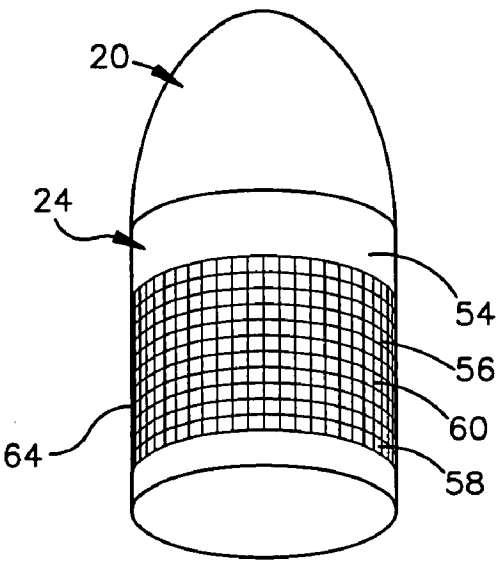
FIG. 4 is an oblique view of a first embodiment fragmentation case in accordance with the present invention.

Referring to FIG. 4, the fragmentation case 54 can include a fragmentation portion 56. The fragmentation portion 56 may include a large number of fragments 58 adhered to the fragmentation case 54 with a high strength adhesive layer 60. In one embodiment, the fragments 58 may be 30-grain cubes of tungsten alloy, having a dimension of approximately 5 mm (0.2 inches). As an alternative to tungsten alloy, one or more metal alloys may be used for the fragments 58. A large number of such fragments 58, for example 25,000 fragments, may be placed on a flat surface and be picked up using high-strength tape, such as high-strength duct tape. A high-strength aerospace structural adhesive may then be applied to a machined-out or otherwise recessed region 64 of the casing 24 of the nose payload portion 20. The tape with the attached fragments 58 may then be wrapped around the high strength adhesive-coated region 64. Once the high strength adhesive has sufficiently set, the fragments 58 preferentially adhere to the high strength adhesive rather than the duct tape. The duct tape is then removed leaving the fragments 58 embedded in the high strength adhesive layer 60 that in turn is attached to the fragmentation case 54. Further steps may be taken to provide a smooth surface for the fragmentation portion 56.

Figure 5:
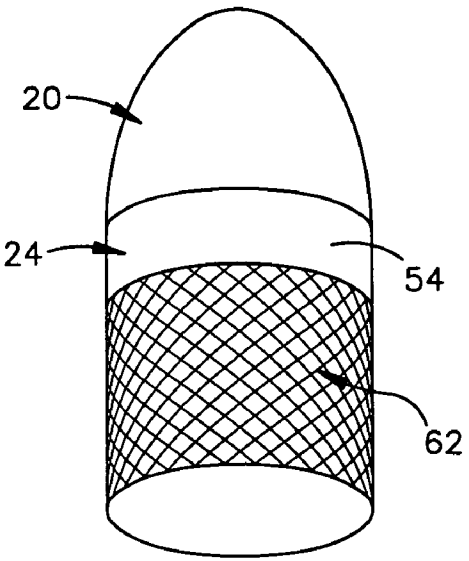
FIG. 5 is an oblique view of a second embodiment fragmentation case in accordance with the present invention.

An alternative type of fragmentation case 54 is illustrated in FIG. 5. A desired portion of the casing 24 of the nose payload portion 20 may be suitably scored, such as by machining grooves 62 on either the inside or outside surface of the casing 24. It will be appreciated that any of a variety of suitable scoring patterns may be employed, such as rectangular patterns or a diamond pattern.

Figure 6:
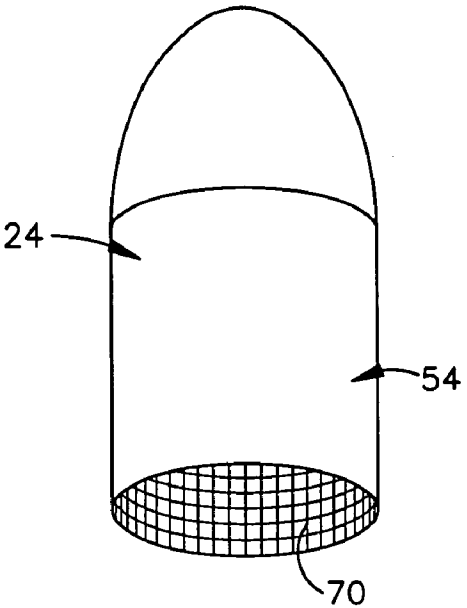
FIG. 6 is an oblique view of a third embodiment fragmentation case in accordance with the present invention.

Another alternative for the fragmentation case 54, as illustrated in FIG. 6, is insertion of a fragmentation liner 70 along the inside of the fragmentation case 54. The pattern of the fragmentation liner 70 creates stress concentrations on the interior surface of the fragmentation case 54, causing the formation of fragments upon detonation of the chemical energy charge 26. It will be appreciated that any of a variety of suitable patterns may be employed for the fragmentation liner 70.

As shown in FIGS. 2 and 3, the fragmentation case 54 may surround most of the chemical energy explosive charge 26. However, it will be appreciated that other configurations and sizes for the fragmentation case 54 may be employed.

Figure 7:
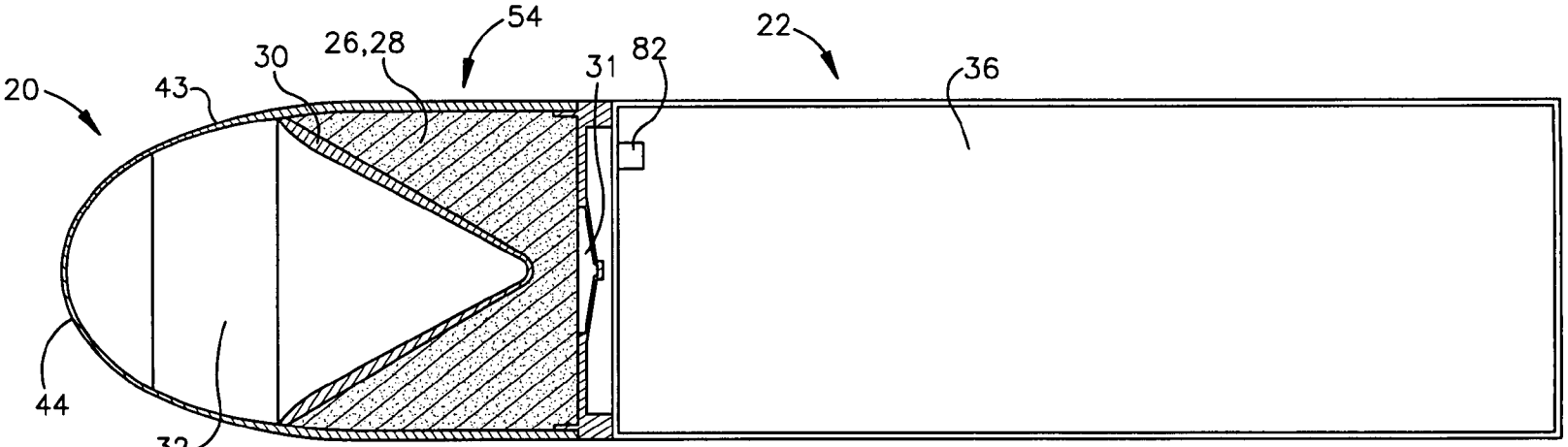
FIG. 7 is a side sectional view of a first embodiment middle payload portion in accordance with the present invention.
Figure 8:
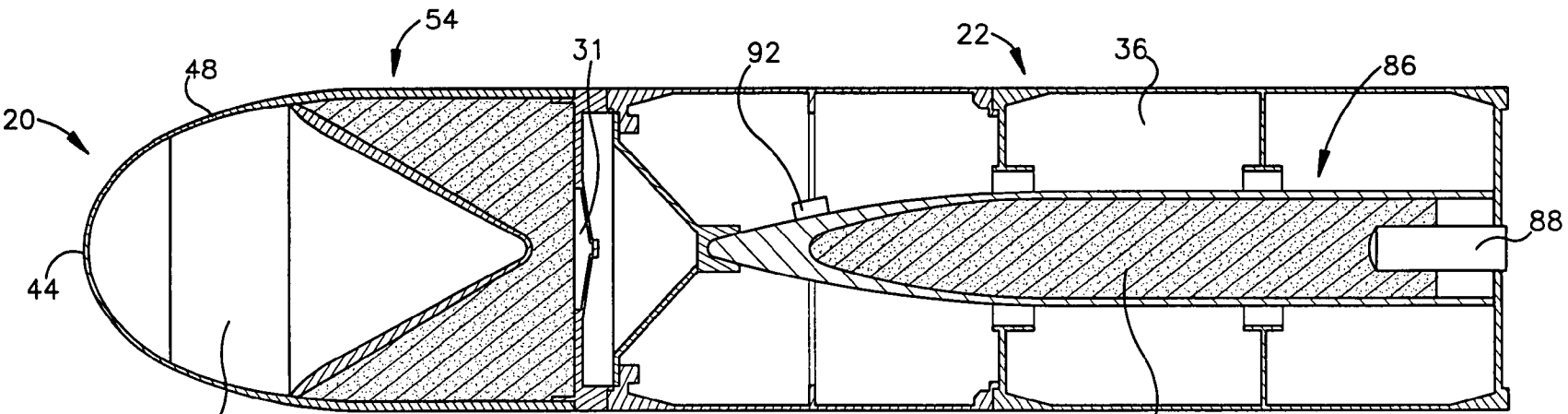
FIG. 8 is a side sectional view of a second embodiment middle payload portion in accordance with the present invention.
Figure 9:
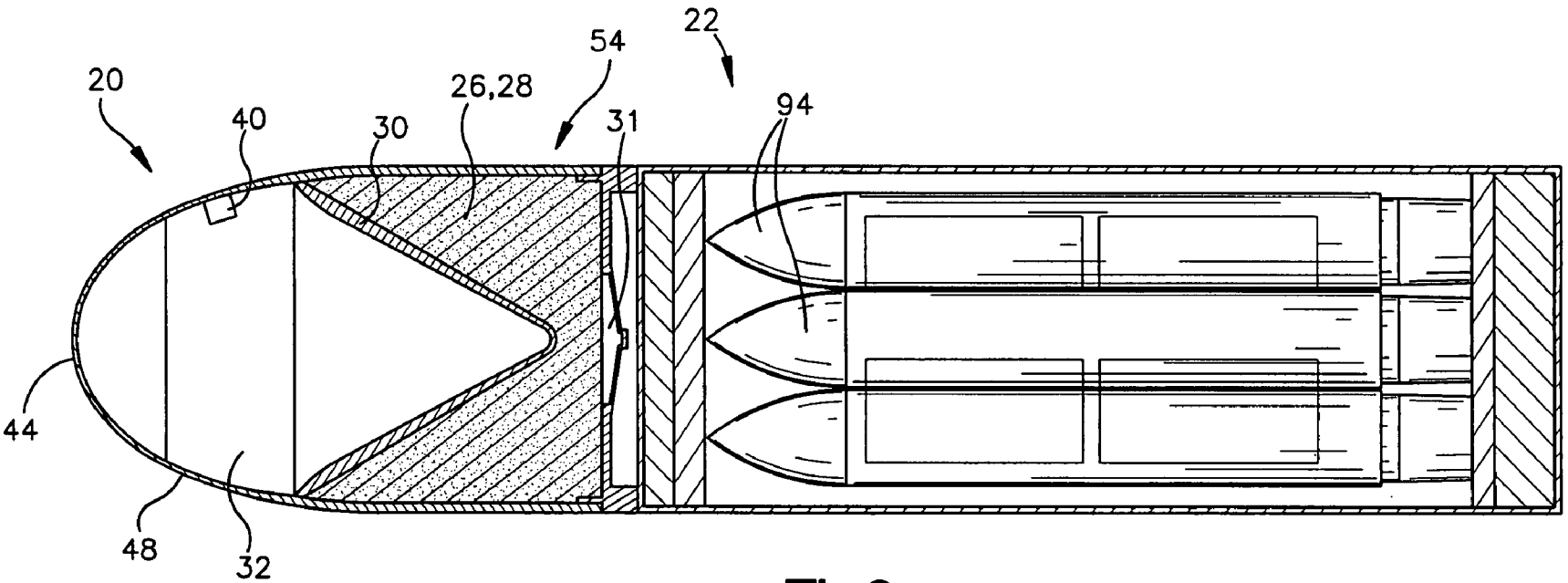
FIG. 9 is a side sectional view of a third embodiment middle payload portion in accordance with the present invention.

FIGS. 7-9 illustrate some possible configurations for the middle payload portion 22. In the configuration illustrated in FIG. 7, the middle payload portion 22 is solely comprised of an aft large volume additional fuel tank 36. An additive mechanism 82 may be installed for providing a fuel additive, such as those described above, into the fuel of the fuel tank 36 prior to or upon detonation of the chemical energy charge 26 and any fuel-air mixture. Alternatively these additives may be used to coat or line various interior surfaces of the aft fuel tank 36.

The nose fuel tank 32 may be coupled to the aft fuel tank 36. Alternatively, the nose fuel tank 32 may be coupled to another fuel tank located elsewhere within the missile 10, for instance in the aft portion 14 of the missile 10.

In the configuration illustrated in FIG. 8, a follow-through munition 86 is provided in the middle payload portion 22. The follow-through munition 86 may be surrounded by the additional fuel tank 36. The follow-through munition 86 may have a separate fuze 88 for detonating an explosive charge 90. A cylindrical wrap, coating or liner of special additives 92 may be directly mounted on the exterior cylindrical surfaces of the follow-through munition 86 for providing an additive, such as those discussed above, to the fuel within the fuel tank 36.

As will be described in greater detail below, the follow-through munition 86 may be configured to detonate after detonation of the chemical energy explosive charge 26. Fixed delay fuzes or "smart" fuzes may be used to segregate the detonation times by 5-30 milliseconds, for example. It will be appreciated that the fuzes 31 and 88 may be configured so as to stagger detonation times to a greater or lesser degree. Following detonation of the chemical energy charge 26, the follow-through munition 86 may continue its travel, passing through the dispersed fuel from the nose fuel tank 32, for example.

The fuze 88 may have similar characteristics to those of the fuze 31 above. It will be appreciated that one of the fuzes 31 and 88 may be one type of fuze, with the other of the fuzes 31 and 88 being another type of fuze.

The follow-through munition 86 may be configured to penetrate hard targets, such as concrete structures. Further information on munitions for penetrating hard targets may be found in U.S. Pat. No. 5,939,662, which is herein incorporated by reference in its entirety. More broadly, the follow-through munition 86 may be any of a variety of suitable munitions, for example, a high performance penetrating warhead for optimum penetration, or a combined blast and fragmentation warhead for spreading explosive effects over a large area.

FIG. 9 illustrates another possible configuration for the middle payload portion 22, with the middle payload portion 22 including a plurality of submunitions 94. The middle payload portion 22 may be configured for the submunitions 94 to be separated from the missile 10 prior to impact and/or detonation of the nose payload portion 20.

Figure 10:
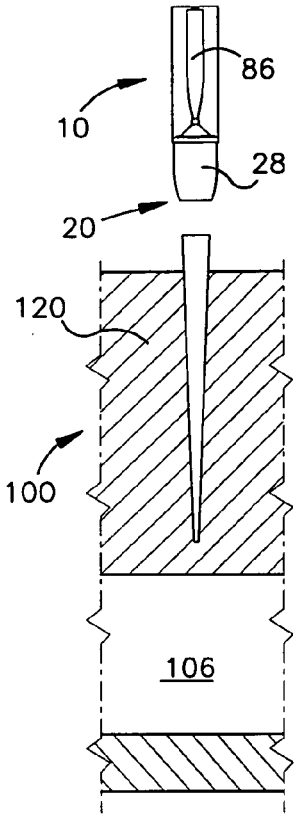
FIG. 10 illustrates a first step in the employment of a missile in accordance with the present invention, against a hard target.
Figure 11:
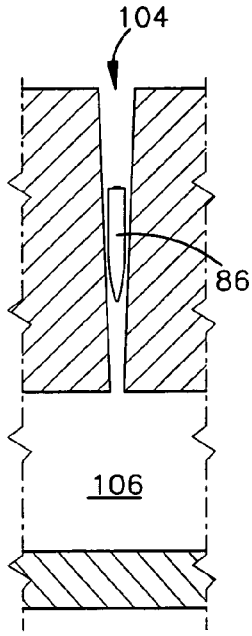
FIG. 11 illustrates a second step in the employment of a missile in accordance with the present invention, against a hard target.
Figure 12:
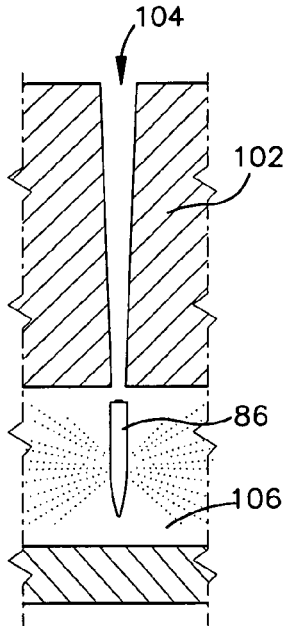
FIG. 12 illustrates a third step in the employment of a missile in accordance with the present invention, against a hard target.

FIGS. 10-12 illustrate use of the missile 10, configured as shown in FIG. 8, against a hard target 100, that is, a target having a strong outer structure 102. As illustrated in FIG. 10, the shaped charged 28 detonates above the target 100, with the blast from the detonation being directed forward in the direction of the flight of the missile 10. The detonation of the shaped charge 28 may be arranged to occur at an optimum height above the target 100, for example, so as to allow optimal performance of the shaped charge jet 28 to perforate the target 100, when combined with the highest velocity of the missile 10.

As illustrated in FIG. 11, detonation of the shaped charge 28 creates a hole 104 in the target structure 102. The follow-through munition 86 may proceed through the hole 104. The follow-through munition 86 may be configured so as to detonate inside a target space 106, after penetrating the outer structure 102 of the target 100, as illustrated in FIG. 12. The fuze 88 of the follow-through munition 86 may be programmed or preset for an expected thickness and strength of the outer structure 102. Alternatively, the fuze 88 may be a smart fuze, such as described earlier, utilizing data from an accelerometer to help select a proper detonation time.

Figure 13:
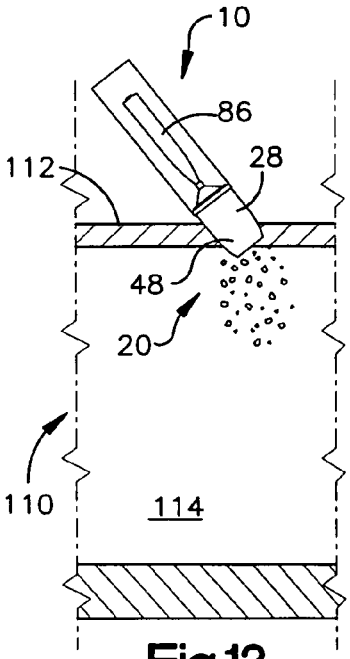
FIG. 13 illustrates a first step in the employment of a missile in accordance with the present invention, against a soft building target.
Figure 14:
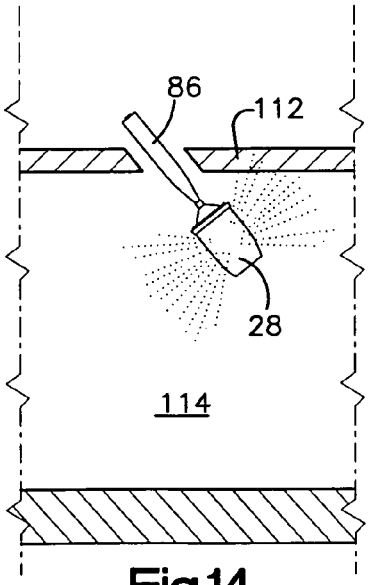
FIG. 14 illustrates a second step in the employment of a missile in accordance with the present invention, against a soft building target.
Figure 15:
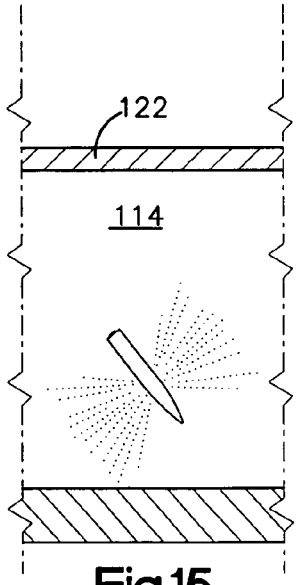
FIG. 15 illustrates a third step in the employment of a missile in accordance with the present invention, against a soft building target.

FIGS. 13-15 show steps in impact of a soft building target 110. A soft building target may be a target with approximately 0.3 meters (1 foot) or less thickness of concrete in an external structure 112, such as a wall or a roof. As illustrated in FIG. 13, the target penetration nose cone 48 is relied upon for breaching the building structure 112. Then, as illustrated in FIG. 14, the shaped charge 28 is initiated within an internal target space 114. Initiation of the shaped charge 28 may also detonate any fuel-air mixture in the nose fuel tank 32 and/or aft fuel tank 36. Finally, as illustrated in FIG. 15 the follow-through munition 86 may be detonated, with the fuzes 31 and 88 being configured for separate ignition of the shaped charge 28 and the follow-through munition 86.

Figure 16:
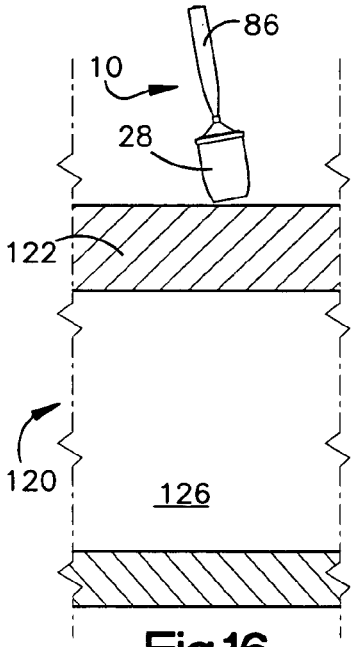
FIG. 16 illustrates a first step in the employment of a missile in accordance with the present invention, against a moderate building target.
Figure 17:
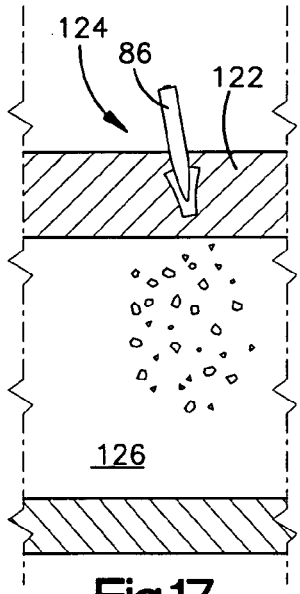
FIG. 17 illustrates a second step in the employment of a missile in accordance with the present invention, against a moderate building target.
Figure 18:
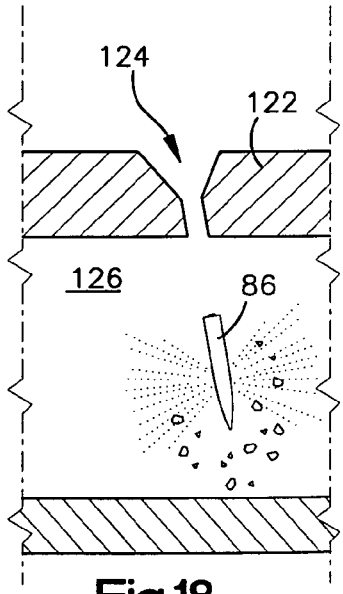
FIG. 18 illustrates a third step in the employment of a missile in accordance with the present invention, against a moderate building target.

FIGS. 16-18 illustrate use of the missile 10 in attacking a moderately hard building target 120, with strength between a soft target and a hard target. For example, the moderate target 120 may have an external structure 122 with strength equivalent to approximately 0.3-0.9 meters of concrete (1-3 feet of concrete). As illustrated in FIG. 16, the detonation of the shaped charge 28 may be accomplished by a crush-switch upon impact of the missile 10 with the target structure 122. The detonation of the shaped charge 28 causes formation of a breaching hole 124 in the outer structure 122, as illustrated in FIG. 17. Finally, in FIG. 18 the follow-through munition 86 detonates causing damage within an internal area 126 of the target 120.

Figure 19:
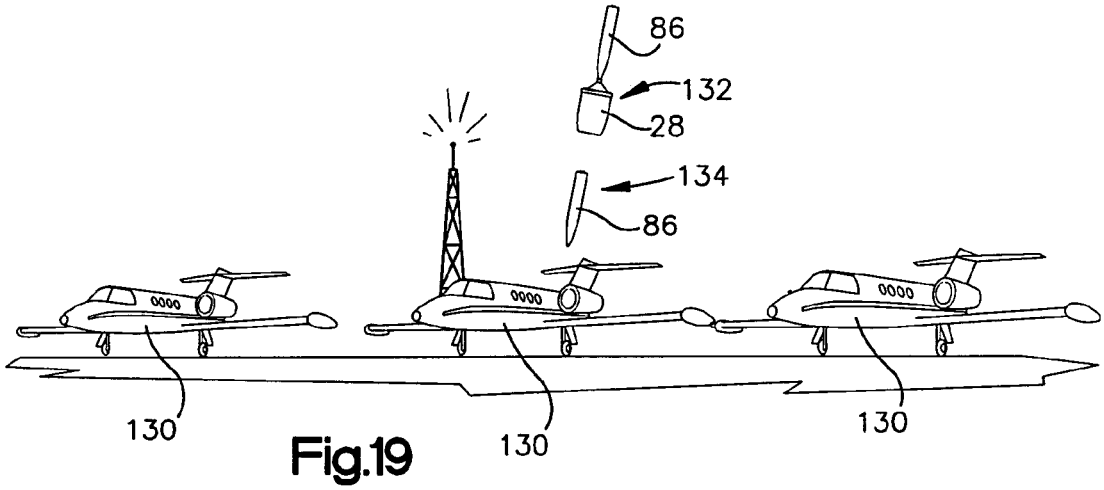
FIG. 19 illustrates the employment of a missile in accordance with the present invention against soft area targets.

FIG. 19 illustrates use of the missile 10, as configured in FIG. 8, against soft area targets 130, such as a plurality of relocatable targets located on the surface that are vulnerable to blast and fragmentation effects. As illustrated at reference number 132, the shaped charge 28 may be detonated at an optimum height above the ground during a steep dive of the missile 10. Then, as indicated at reference number 134, the follow-through munition 86 detonates at a lower altitude. The combined detonations of the shaped charge 28 and the follow-through munition 86, along with any detonated fuel-air mixture, spreads a large blast/fragmentation cloud over a wide area, to defeat the plurality of relocatable targets 130.

From the foregoing it will be seen that the missile and components described above provide a single system capable of attacking a wide variety of targets. In addition, the missile and components provide a number of different means of penetrating targets, so as to increase internal damage to targets. It will be appreciated that other configurations of the missile 10 may be used in other suitable ways to attack a variety of different types of targets.

The missile 10 thus is able to defeat a broad spectrum of soft to hard ground-based targets with a single missile variant. The many benefits the missile 10 provides include: increased mission flexibility, improved missile lethality against a much broader set of targets, reduced logistics complexity, and reduced cost to fight and win a conflict or war. In addition, missiles such as described herein may allow for reduced ordnance requirements, as the missiles may be utilizable for multiple types of missions. Thus, the stocking of a wide variety of different types of missiles for different types of targets may be avoided and resupply logistics greatly reduced.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A missile nose payload portion comprising:

a casing that includes a target penetration nose cone; and an explosive charge within the casing;

wherein the casing also includes a frangible nose cover that covers a cutout in the target penetration nose cone;

wherein the cutout in the target penetration nose cone is a central opening in a forward tip of the nose cone, such that a longitudinal axis of the missile passes through the cutout, and does not pass through the nose cone;

wherein the frangible nose cover is weaker than the target penetration nose cone;

wherein the target penetration nose cone and the frangible nose cover together have a single continuous smooth outer surface shape, without any substantial shape discontinuity at a boundary between the target penetration nose cone and the frangible nose cover; and wherein the target penetration nose cone extends forward of the explosive charge and tapered inward to the cutout such that a cutout diameter of the cutout is less than about 75% of an overall diameter of the missile.

2. The nose payload portion of claim 1, wherein the target penetration nose cone includes a material selected from a group consisting of one or more of a metal, an alloy and a high strength composite.

3. The nose payload portion of claim 2, wherein the target penetration nose cone has a thickness greater than about 6.4 mm (0.25 inches).

4. The nose payload portion of claim 1, wherein a cutout diameter of the cutout is greater than about 25% of the overall diameter of the missile.

5. The nose payload portion of claim 1, wherein the frangible nose cover has a thickness of less than about 6.4 mm (0.26 inches).

6. The nose payload portion of claim 1, wherein the frangible nose cover is thinner than the target penetration nose cone.

7. The nose payload portion of claim 1, wherein the frangible nose cover includes a material of lower density than steel.

8. The nose payload portion of claim 7, wherein the explosive charge includes a shaped charge;

wherein the frangible nose cover overlies a front surface of at least a center portion of the shaped charge; and wherein the frangible nose cover is configured to be perforated by explosive force of the shaped charge.

9. The nose payload portion of claim 1, wherein the explosive charge includes a shaped charge.

10. The nose payload portion of claim 1, wherein the explosive charge includes a platter charge, an explosively formed penetrator, a flyer plate, or another explosive device or explosive filling.

11. The nose payload portion of claim 1, wherein the casing includes a fragmentation case.

12. The nose payload portion of claim 11, wherein the fragmentation case is located aft of the target penetration nose cone.

13. The nose payload portion of claim 11, wherein the fragmentation case includes a plurality of fragments, located in a recess in the casing or on the surface of the casing.

14. The nose payload portion of claim 13, wherein the fragments are made of one or more metal alloys.

15. The nose payload portion of claim 13, wherein the fragments are embedded in a high strength adhesive within the recess or on the surface of the casing.

16. The nose payload portion of claim 11, wherein the fragmentation case is scored on either the inside or outside surface of the casing to produce enhanced fragmentation effects.

17. The nose payload portion of claim 11, wherein the fragmentation includes a fragmentation liner within the fragmentation case to produce enhanced fragmentation effects.

18. The nose payload portion of claim 1, wherein substantially all of the frangible nose cover is longitudinally forward of substantially all of the target penetration nose cone.

19. The nose payload portion of claim 1, wherein the explosive charge is within a cylindrical aft part of the casing; and wherein the explosive charge extends substantially fully across the cylindrical aft part of the casing.

20. The nose payload portion of claim 1, as part of a powered cruise missile.

21. A missile nose payload portion comprising:

a casing that includes a target penetration nose cone;

an explosive charge within the casing; and a nose cone fuel tank within the casing, forward of the explosive charge;

wherein the casing also includes:

a frangible nose cover, substantially all of which is longitudinally forward of substantially all of the target penetration nose cone; and a fragmentation case located aft of the target penetration nose cone;

wherein the frangible nose cover is of lower density than target penetration nose cone material of the target penetration nose cone;

wherein the nose cone fuel tank contains a liquid fuel;

wherein the target penetration nose cone has a diameter at least as large as a diameter of the explosive charge;

wherein the frangible nose cover covers a cutout in the target penetration nose cone;

wherein the cutout in the target penetration nose cone is a central opening in a forward tip of the nose cone, such that a longitudinal axis of the missile passes through the cutout, and does not pass through the nose cone; and wherein the target penetration nose cone extends over substantially all of a front surface of the missile nose payload portion.

* * * * *